US010350467B2

(12) United States Patent
Ban

(10) Patent No.: US 10,350,467 B2
(45) Date of Patent: Jul. 16, 2019

(54) GOLF CLUB HEAD

(71) Applicant: Bridgestone Sports Co., Ltd., Tokyo (JP)

(72) Inventor: Wataru Ban, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/924,670

(22) Filed: Mar. 19, 2018

(65) Prior Publication Data

US 2018/0311539 A1 Nov. 1, 2018

(30) Foreign Application Priority Data

Apr. 26, 2017 (JP) ..... 2017-087492

(51) Int. Cl.
*A63B 53/04* (2015.01)

(52) U.S. Cl.
CPC .... *A63B 53/047* (2013.01); *A63B 2053/0445* (2013.01)

(58) Field of Classification Search
CPC ..... A63B 2053/0445
USPC ..... 473/330, 331
See application file for complete search history.

(56) References Cited

U.S. PATENT DOCUMENTS

D63,284 S * 11/1923 Challis ..... 473/331
7,179,175 B2 * 2/2007 Kennedy, III ..... A63B 53/04 473/330
7,749,099 B2 7/2010 Ban et al.
9,028,340 B2 * 5/2015 Ban ..... A63B 53/047 473/331
9,033,820 B2 * 5/2015 Kato ..... A63B 53/047 473/331
9,149,692 B2 * 10/2015 Shimahara ..... A63B 60/00
9,216,328 B2 12/2015 Hipp
9,539,477 B2 1/2017 Ripp et al.
9,737,771 B2 * 8/2017 Simone ..... A63B 53/047
2010/0113180 A1 * 5/2010 Nakamura ..... A63B 53/047 473/331
2011/0269568 A1 * 11/2011 Ban ..... A63B 53/04 473/331

(Continued)

FOREIGN PATENT DOCUMENTS

JP 3919867 B2 5/2007
JP 2009-153922 A 7/2009
JP 5237014 B2 7/2013

*Primary Examiner* — Mark S Graham
(74) *Attorney, Agent, or Firm* — Sughrue Mion, PLLC

(57) ABSTRACT

A golf club head includes a face portion, score lines n the face portion and extending in a toe-heel direction, protruding portions formed on the face portion and extending parallel to the score lines, and recessed portions formed on the face portion and extending parallel to the score lines. Each protruding portion and each recessed portion are formed alternately in a direction orthogonal to the toe-heel direction. The protruding portions include first protruding portions and second protruding portions. Each apex portion of the first protruding portions is positioned in a first imaginary plane parallel to a reference plane that contains each edge of the score lines. Each apex portion of the second protruding portions is positioned in a second imaginary plane parallel to the reference plane and different from the first imaginary plane.

9 Claims, 6 Drawing Sheets

(56) References Cited

U.S. PATENT DOCUMENTS

| | | | | |
|---|---|---|---|---|
| 2011/0300967 | A1* | 12/2011 | Ban | A63B 53/04 473/331 |
| 2013/0303303 | A1* | 11/2013 | Ban | B23P 17/00 473/331 |
| 2013/0310192 | A1* | 11/2013 | Wahl | C25D 1/00 473/331 |
| 2014/0206472 | A1* | 7/2014 | Aguayo | B23K 26/0006 473/331 |
| 2014/0352391 | A1* | 12/2014 | Gilbert | A63B 53/04 72/352 |
| 2015/0024868 | A1 | 1/2015 | Simone | |
| 2016/0008678 | A1* | 1/2016 | Kitagawa | A63B 53/0466 473/331 |
| 2016/0361607 | A1* | 12/2016 | Huang | A63B 53/04 |
| 2017/0197121 | A1* | 7/2017 | Franklin | A63B 53/0487 |
| 2018/0126230 | A1* | 5/2018 | Tassistro | A63B 53/047 |

* cited by examiner

GOLF CLUB HEAD

BACKGROUND OF THE INVENTION

Field of the Invention

The present invention relates to a golf club head.

Description of the Related Art

Golf club heads in which score lines and fine unevenness are formed on the face portion have been proposed (e.g., Japanese Patent No. 5237014, Japanese Patent Laid-Open No. 2009-153922, Japanese Patent No. 3919867, U.S. Pat. Nos. 9,539,477, 9,216,328, and US-2015-0024868). Score lines and fine unevenness have the effect of increasing the amount of backspin on the hall or suppressing a marked reduction in the amount of backspin on the ball in the case of wet weather or shots from the rough.

Advanced players prefer a golf club head that allows the amount of spin on the ball to be easily controlled. Conventional golf club heads have room for improvement in the controllability of the amount of spin.

SUMMARY OF THE INVENTION

It is an object of the present invention to provide a golf club head that allows the amount of spin on the ball to be easily controlled.

According to an aspect of the present invention, there is provided a golf club head comprising: a face portion; a plurality of score lines formed on the face portion and extending in a toe-heel direction; a plurality of protruding portions formed on the face portion and extending parallel to the plurality of score lines; and a plurality of recessed portions formed on the face portion and extending parallel to the plurality of score lines, wherein each protruding portion of the plurality of protruding portions and each recessed portion of the plurality of recessed portions are formed alternately in a direction orthogonal to the toe-heel direction, the plurality of protruding portions include a plurality of first protruding portions and a plurality of second protruding portions, each apex portion of the plurality of first protruding portions is positioned in a first imaginary plane parallel to a reference plane that contains each edge of the plurality of score lines, and each apex portion of the plurality of second protruding portions is positioned in a second imaginary plane parallel to the reference plane and different from the first imaginary plane.

Further features of the present invention will become apparent from the following description of exemplary embodiments (with reference to the attached drawings).

DESCRIPTION OF THE EMBODIMENTS

First Embodiment

Figure 1:
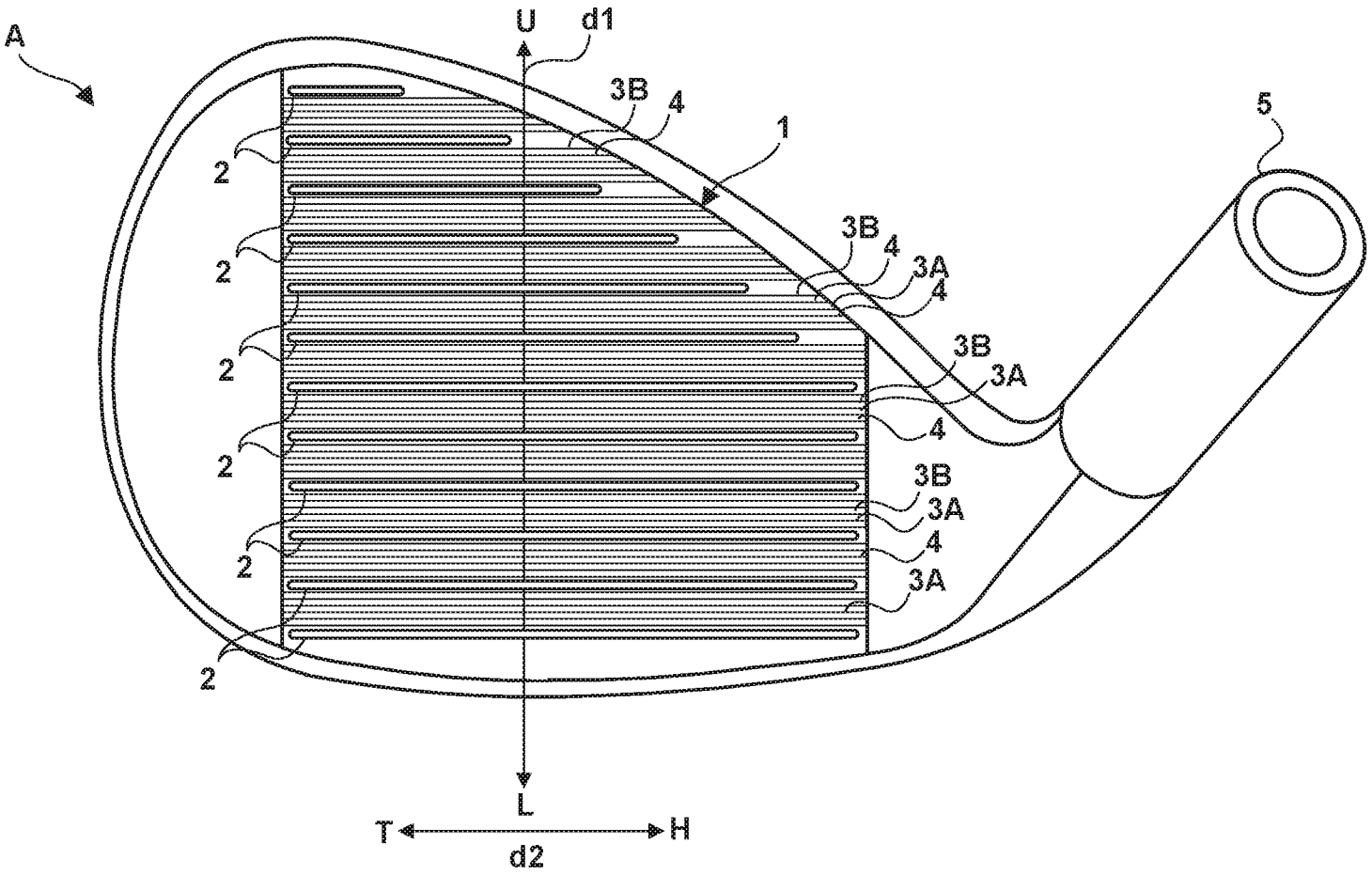
FIG. 1 is an external view of a golf club head according to one embodiment of the present invention.

FIG. 1 is an external view of a golf club head A according to one embodiment of the present invention. The example of FIG. 1 shows an example in which the present invention is applied to an iron-type golf club head. The present invention is suitable for the manufacture of iron-type golf club heads, particularly middle iron, short iron and wedge-type golf club heads. Specifically, the present invention is suitable for the manufacture of golf club heads having a loft angle from 30 degrees to 70 degrees inclusive and a head weight from 240 g to 320 g inclusive. However, the present invention is also applicable to the manufacture of wood-type and utility-type (hybrid-type) golf club heads.

The golf club head A is provided with a face portion 1 and a hosel portion 5. The face portion 1 forms a striking face that strikes the golf ball. A shaft which is not shown is mounted in the hosel portion 5. In FIG. 1, an arrow d2 indicates a toe-heel direction, with T indicating the toe side and H indicating the heel side. An arrow d1 indicates a direction that is orthogonal to the toe-heel direction and follows the striking face. U indicates the upper side when the sole portion of the head A is grounded, and L indicates the lower side when the sole portion of the head A is grounded.

Figure 2:
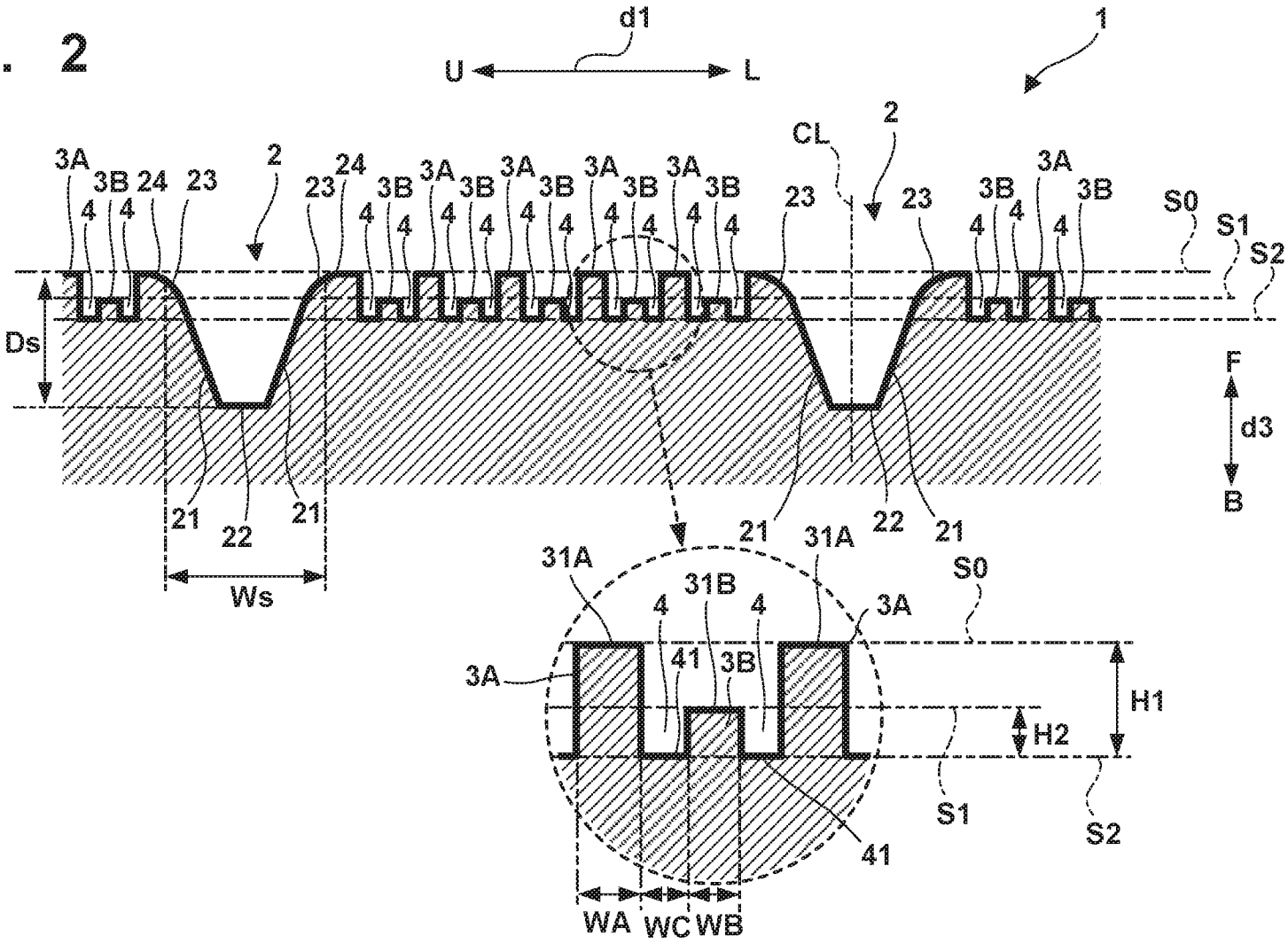
FIG. 2 is a cross-sectional view and a partial enlarged view of score lines, protruding portions and recessed portions.

A plurality of score lines 2, a plurality of protruding portions 3A and 3B (collectively referred to as protruding portions 3), and a plurality of recessed portions 4 are formed on the face portion 1. The score lines 2, the protruding portions 3 and the recessed portions 4 will be described with reference to FIG. 2. FIG. 2 is a partial cross-sectional view and an enlarged view of the face portion 1 in a d1 direction, and shows a cross-sectional view between score lines 2 that are adjacent in the d1 direction.

The plurality of score lines 2 are disposed parallel to each other in the d1 direction. Each of the score lines 2 is a linear groove running in a d2 direction. In the case of the present embodiment, the interval (pitch) at which the individual score lines 2 are disposed is a regular interval (equal pitch), but the score lines may be arranged at different pitches. In the present embodiment, the cross-sectional shape of the score lines 2 is the same, except for both end portions (toe side end portion, heel side end portion) in the longitudinal direction. Also, the individual score lines 2 have the same cross-sectional shape.

The score lines 2 each have a pair of side walls (side portions) 21 and bottom walls (bottom portions) 22, and the cross-sectional shape thereof is formed to be a symmetrical trapezoid with respect to a central line in the d1 direction. Note that the cross-sectional shape of the score lines 2 is not limited to being trapezoidal, and may be other shapes, such as V-shaped. Edge portions 23 of the score lines 2 are rounded. The radius of the rounding is from 0.05 mm to 0.3 mm inclusive. An edge 24 of each edge portion 23 of the score lines 2 is contained in a reference plane S0. The reference plane S0 is an imaginary flat plane. The edge 24 is the end of the rounding of the edge portion 23 in the d1 direction. The reference plane S0 in the present embodiment may be referred to as the striking face or the face surface. An arrow d3 in FIG. 2 indicates a thickness direction of the face portion 3, and is a direction orthogonal to the reference plane S0. F indicates the outer side of the reference plane S0, and B indicates the inner side (back side of the head; the bottom wall 22 side of the score lines 2) of the reference plane S0.

A depth (distance between the bottom wall 22 and a reference plane S0) Ds of the score lines 2 is preferably 0.3 mm or more. In the case where the golf club head A is for competitive use, the depth Ds is set to 0.5 mm or less in terms of complying with the rules. A width (width obtained by the 30-degree measurement method) Ws of the score lines 2 is preferably 0.6 mm or more. In the case where the golf club head A is for competitive use, the width Ws is set to 0.9 mm or less in terms of complying with the rules.

The protruding portions 3 and the recessed portions 4 extend parallel to the score lines 2. The protruding portions 3 and the recessed portions 4 are formed alternately in the d1 direction between the adjacent score lines 2. In other words, as a result of forming the recessed portions 4, the protruding portions 3 are formed between the adjacent recessed portions 4. Two types of protruding portions 3 are formed in the present embodiment, namely, the protruding portions 3A and 3B. Focusing on the array of protruding portions 3 in the d1 direction, the protruding portions 3A and 3B are formed alternately between the adjacent score lines 2. Accordingly, the protruding portions 3 and the protruding portions 4 are formed in the following order when viewed in the d1 direction: protruding portion 3A→recessed portion 4→protruding portion 3B→recessed portion 4→protruding portion 3A→recessed portion 4→protruding portion 3B.

The height (length in the d3 direction) from a bottom wall (bottom portion) 41 of the recessed portions 4 differs between the protruding portions 3A and 3B. The bottom wall 41 of the recessed portions 4 is positioned in an imaginary plane S2. The imaginary plane S2 is a flat plane parallel to the reference plane S0, and the bottom wall 41, in the case of the present embodiment, is a flat plane. The imaginary plane S2 is positioned on the back side of the reference plane S0 in the d3 direction.

An apex portion 31A of the protruding portions 3A is positioned in the reference plane S0, and an apex portion 31B of the protruding portions 3B is positioned in an imaginary plane S1. The imaginary plane S1 is a flat plane parallel to the reference plane S0, and is positioned between the imaginary plane S2 and the reference plane S0 when viewed in the d3 direction. The height of the apex portion 31A from the bottom wall 41 (interval between the reference plane S0 and the imaginary plane S2) is H1, and the protruding portions 3A have a uniform height. Similarly, the height of the apex portion 31B from the bottom wall 41 (interval between the imaginary plane S1 and the imaginary plane S2) is H2 (<H1), and the protruding portions 3B also have a uniform height. The height H1 is, in other words, equal to the depth of the recessed portions 4 from the reference plane S0. In the case where the golf club head A is for competitive use, H1 is set to 25 μm or less, in terms of complying with the rules. H1 is preferably 10 μm or more, and H2 is preferably from 5 μm to 15 μm inclusive. Note that the apex portion 31A may be positioned in another imaginary plane parallel to the reference plane S0, and this imaginary plane may be an imaginary plane that is positioned between the reference plane S0 and the imaginary plane S1.

In the case of the present embodiment, the cross-sectional shape of cut sections of the protruding portions 3A and 3B and the recessed portions 4 in the d1 direction is rectangular, and the cross-sectional shape has, in other words, a form whereby the protruding portions 3B project from the bottom wall of the rectangular grooves between adjacent protruding portions 3A. The relationship between the respective widths WA, WB and WC of the protruding portions 3A, the recessed portions 4 and the protruding portions 3B is, for example, as follows: 50 μm≤WA≤200 μm, 50 μm≤WB≤200 μm, and 50 μm≤WC=200 μm.

Next, the controllability of the amount of spin of the golf ball by the protruding portions 3 will be described. At impact, the golf ball deforms so as to squashed by the surface of the face portion 1, with the amount of deformation in the case where striking force is small (in the case where head speed is low) being small, and the amount of deformation in the case where striking force is large (in the case where head speed is high) being large. The height from the bottom wall (bottom portion) 41 of the recessed portions 4 differs between the protruding portions 3A and 3B, and the protruding portions 3A contribute to increasing the amount of spin of the golf ball, since the contact points of the protruding portions 3A with the golf ball do not change all that much depending on the amount of deformation of the golf ball. On the other hand, in the case where the amount of deformation of the golf ball is small, the contact points between the protruding portions 3B and the golf ball decrease, and, conversely, in the case where the amount of deformation of the golf ball is large, the contact points between the protruding portions 3B and the golf ball increase. Accordingly, the amount of spin decreases in the case where head speed is low, and the amount of spin increases in the case where head speed is high. The golfer is able to adjust the amount of spin on the ball by adjusting head speed. Accordingly, with the present embodiment, a golf club that allows the amount of spin on the ball to be easily controlled can be provided.

In the case of the present embodiment, the protruding portions 3A and 3B may be disposed in any pattern in the d1 direction, but are disposed alternately in the present embodiment, thus enabling the controllability of the amount of spin to be further improved, since the amount of spin is not readily affected by the impact point of the golf ball on the face portion 1. Also, because the cross-section of the protruding portions 3A and 3B has a rectangular shape, the corner portions thereof readily hold the golf ball, making it easier to obtain more spin. Because the cross-sectional shape of the recessed portions is also rectangular and the bottom wall 41 is a planar surface, it is easy to judge whether the recessed portions have become clogged with grass or other foreign matter from the condition of light reflected by the bottom wall 41, and to visually ascertain the timing of maintenance thereof.

The protruding portions 3 and the recessed portions 4 can be formed by laser processing or cutting. FIG. 3A illustrates an apparatus for forming the protruding portions 3 and the recessed portions 4 by laser processing. As shown in FIG. 3A, a primary molded article A' on which the protruding portions 3 and the recessed portions 4 are not formed is fixed to a processing apparatus which is not shown via a jig 100. The processing apparatus has an irradiation unit 101 that irradiates a laser beam. The protruding portions 3 and the recessed portions 4 are formed while moving the face portion 1 (primary molded article A') and the irradiation unit 101 relative to each other in the d2 direction while irradiating the face portion 1 with a laser beam by the irradiation unit 101. The primary molded article A' may have the score lines 2 formed thereon, or the score lines 2 may be formed by laser processing together with the protruding portions 3 and the recessed portions 4.

Figure 3B:
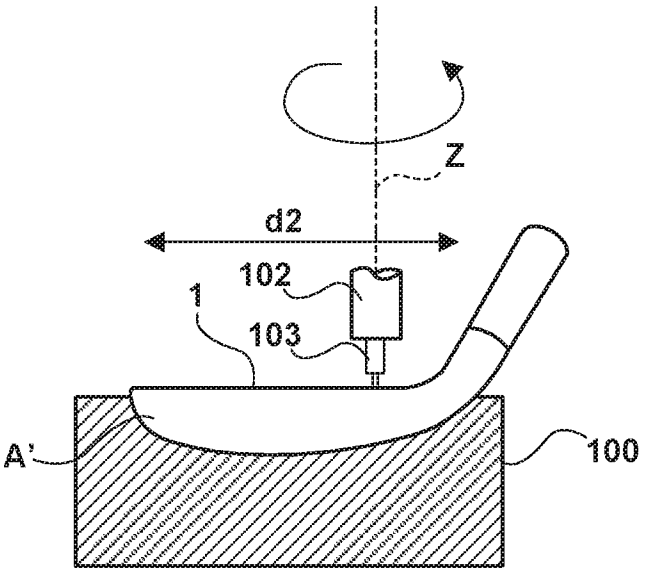
FIGS. 3A and 3B are illustrative diagrams of examples of forming the protruding portions and the recessed portions.
Figure 3A:
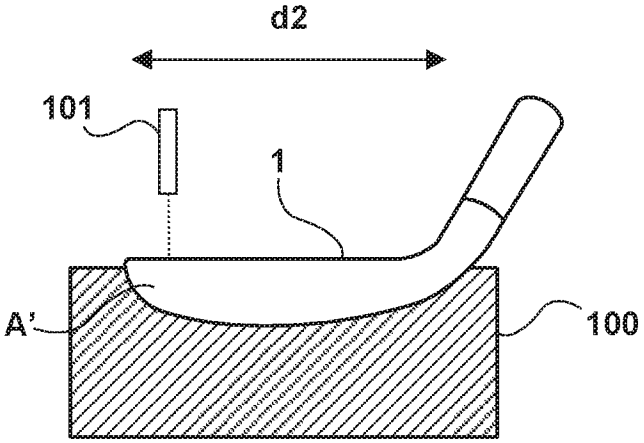

FIG. 3B is an illustrative diagram of the case where cutting is performed using an NC milling machine. A primary molded article A' on which the protruding portions 3 and the recessed portions 4 are not formed is fixed to an NC milling machine via a jig 100. The NC milling machine has a spindle 102 that is rotationally driven about a Z-axis, and a cutting tool (end mill) 103 is attached to the lower end of the spindle 102. The protruding portions 3 and the recessed portions 4 are formed by moving the face portion 1 (primary molded article A') and the cutting tool 103 relative to each other in the d2 direction. The primary molded article A' may have the score lines 2 formed thereon, or the score lines 2 may formed by cutting together with the protruding portions 3 and the recessed portions 4.

Note that a surface treatment for increasing the hardness of the face portion 1 is preferably performed, after the formation of the protruding portions 3 and the recessed portions 4. Carburizing, nitriding, nitrocarburizing, physical vapor deposition (PVC), ion plating, diamond-like carbon (DLC) treatment, plating and the like are given as examples of such a surface treatment. In particular, a surface treatment that modifies the surface, rather than forming another metal layer on the surface, such as carburizing or nitriding, is preferable.

Second Embodiment

Figure 4:
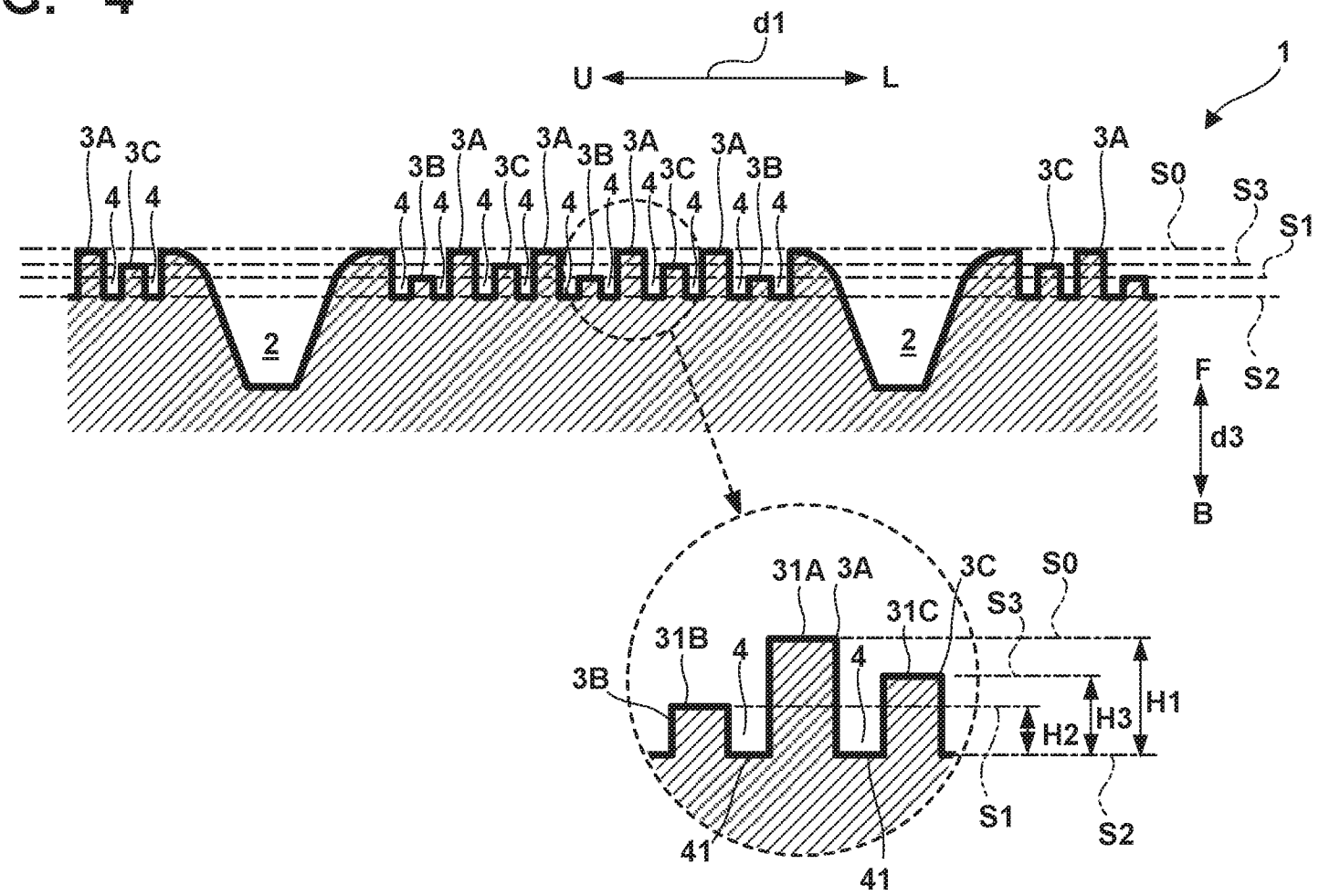
FIG. 4 is a cross-sectional view and a partial enlarged view of the protruding portions and the recessed portions of another example.

In the first embodiment, there are two types of protruding portions 3, but there may be three or more types. FIG. 4 illustrates an example in which three types of protruding portions, namely, protruding portions 3A to 3C, having different heights from the imaginary plane 52 are formed. Focusing on the array of protruding portions 3 in the d1 direction, the protruding portions 3A to 3C are arrayed in a certain order between the adjacent score lines 2. In the case of the present embodiment, the protruding portions 3A are formed alternately with the protruding portions 3B and the protruding portions 3C, and the protruding portions 3B and the protruding portions 3C are disposed alternately to each other. Accordingly, the protruding portions 3 and the protruding portions 4 are formed in the following order when viewed in the d1 direction: protruding portions 3A→recessed portions 4→protruding portions 3B→recessed portions 4→protruding portions 3A→recessed portions 4→protruding portions 3C.

The height (length in the d3 direction) from the bottom wall (bottom portion) 41 of the recessed portions 4 differs between the protruding portions 3A to 3C. The apex portion 31A of the protruding portions 3A is positioned in the reference plane S0, the apex portion 31B of the protruding portions 3B is positioned in the imaginary plane S1, and an apex portion 31C of the protruding portions 3C is positioned in an imaginary plane S3. The imaginary plane S3 is a flat plane parallel to the reference plane S0, and is positioned between the imaginary plane S1 and the reference plane S0 when viewed in the d3 direction. The height of the apex portion 31A from the bottom wall 41 (interval between the reference plane S0 and the imaginary plane S2) is H1, the height of the apex portion 31B from the bottom wall 41 (interval between the imaginary plane S1 and the imaginary plane S2) is H2 (<H1), the height of the apex portion 31C from the bottom wall 41 (interval between the imaginary plane S3 and the imaginary plane S2) is H3 (<H1 and >H2), and the protruding portions 3C have a uniform height. H1 is preferably from 10 μm to 25 μm inclusive, H2 is preferably from 5 μm to 15 μm inclusive, and H3 is preferably from 10 μm to 20 μm inclusive. Note that the apex portion 31A may be positioned in another imaginary plane parallel to the reference plane S0, and this imaginary plane may be an imaginary plane positioned between the reference plane S0 and the imaginary plane S3.

In the present embodiment, control of the amount of spin is adjustable over more stages than the first embodiment. In the case where the amount of deformation of the golf ball is small, the contact points between the protruding portions 3B and 3C and the golf ball decrease, and, in the case where the amount of deformation of the golf ball is moderate, the contact points between the protruding portions 3C and the golf ball increase and the contact points between the protruding portions 3B and the golf ball remain largely unchanged. In the case where the amount of deformation of the golf ball is large, the contact points between the protruding portions 3B and 3C and the golf ball increase.

Accordingly, the amount of spin decreases in the case where head speed is low, the amount of spin increases slightly in the case where head speed is moderate, and the amount of spin increases in the case where head speed is high. The golfer is able to adjust the amount of spin on the ball by adjusting head speed.

Third Embodiment

Figure 5:
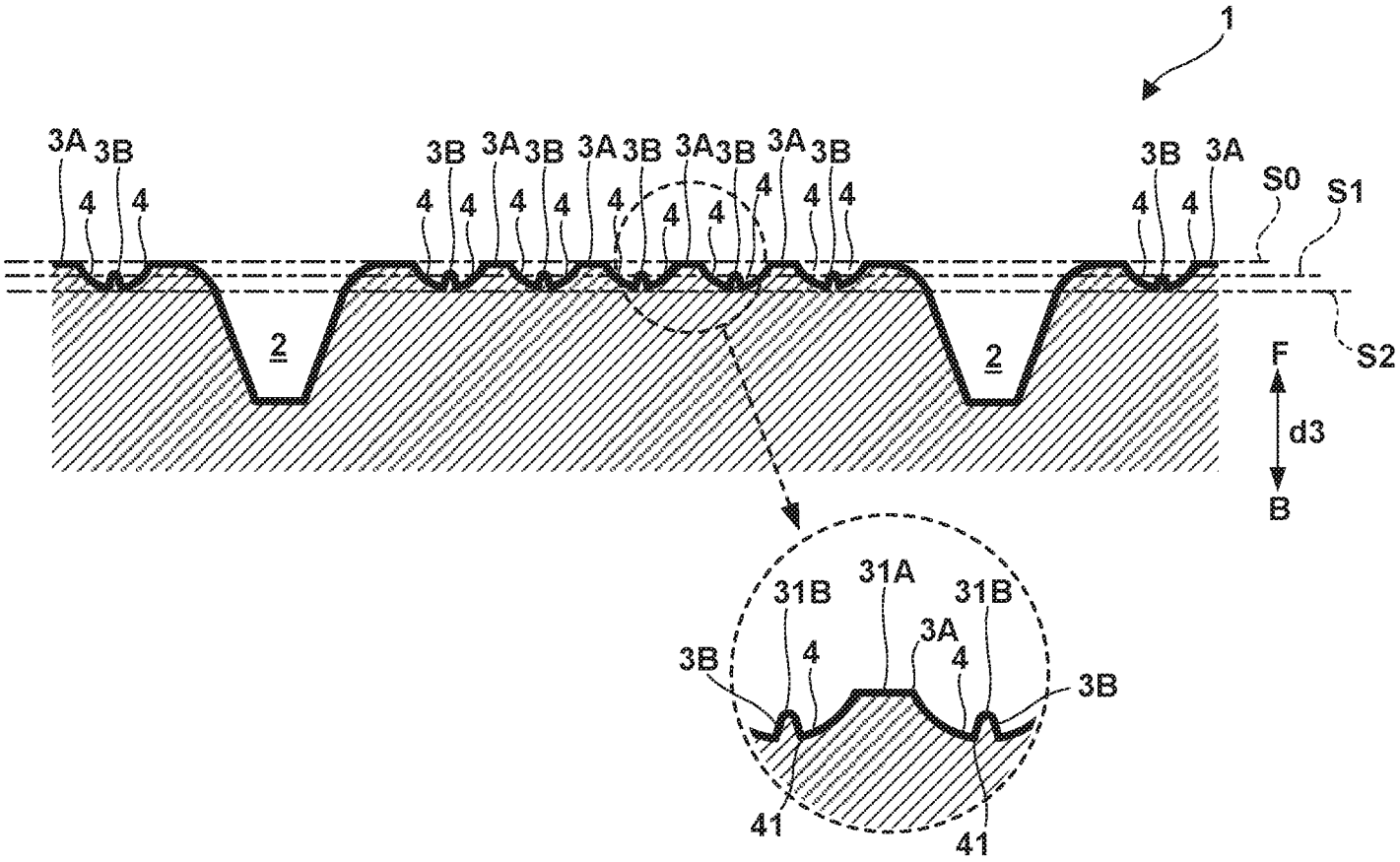
FIG. 5 is a cross-sectional view and a partial enlarged view of the protruding portions and the recessed portions of another example.

In the first embodiment, the cross-sectional shape of the protruding portions 3 and the recessed portions 4 is rectangular, but may be other shapes. FIG. 5 shows an example of such a configuration. In the example of FIG. 5, there are two types of protruding portions 3, namely, the protruding portions 3A and 3B, and the heights and cross-sectional shapes differ from each other. The cross-sectional shape of the protruding portions 3A is trapezoidal or chevron-shaped, and the cross-sectional shape of the protruding portions 3B is semi-elliptical. The cross-section of the recessed portions 4 has a beak shape that is horizontally reversed alternately.

Fourth Embodiment

Figure 6:
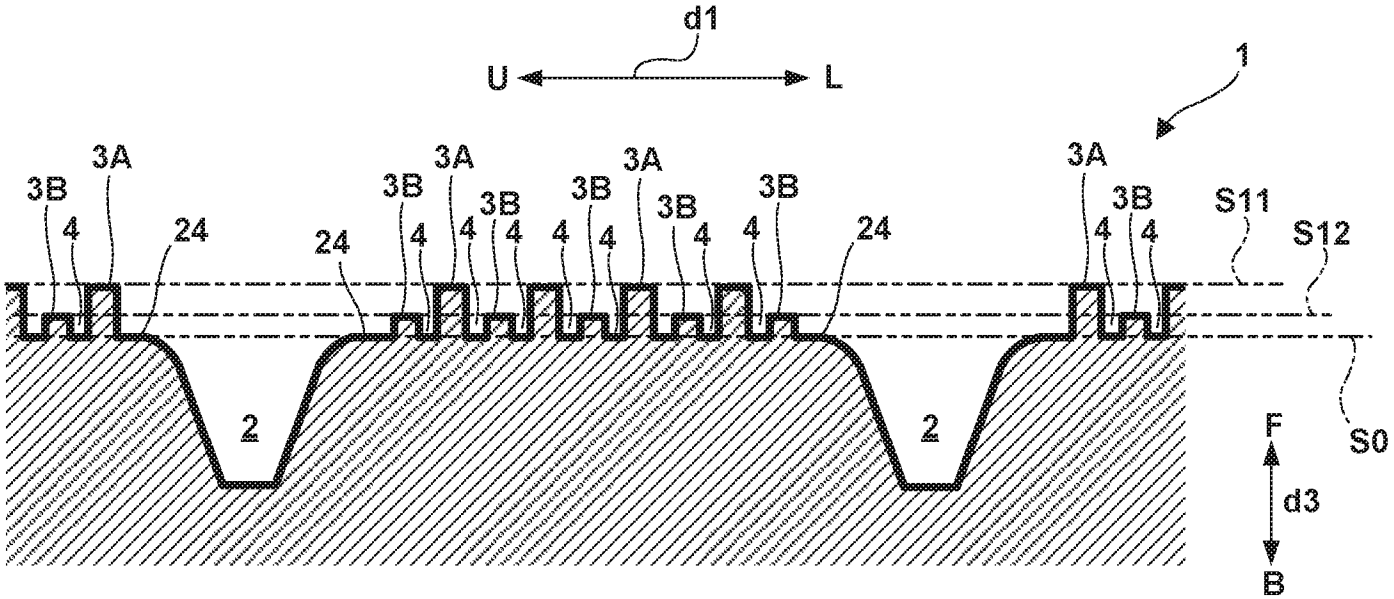
FIG. 6 is a cross-sectional view of the protruding portions and the recessed portions of another example.

In the first embodiment, the protruding portions 3 and the recessed portions 4 are formed on the back side of the reference plane S0 in the d3 direction, but may be formed on the outer side of the reference plane S0 in the d3 direction. FIG. 6 shows an example of such a configuration. In the example of FIG. 6, there are two types of protruding portions 3, namely, the protruding portions 3A and 3B, and the heights thereof differ from each other. The cross-sectional shape is rectangular. The protruding portions 3A and 3B project on the outer side of the reference plane S0 in the d3 direction. The cross-sectional shape of the recessed portions 4 is rectangular.

The apex portion of the protruding portions 3A is positioned in an imaginary plane S11, and the apex portion of the protruding portions 3B is positioned in an imaginary plane S12. The bottom portion of the recessed portions 4 is positioned in the reference plane S0. The imaginary plane S11 and the imaginary plane S12 are parallel to the reference plane S0, and are positioned on the outer side of the reference plane S0 in the d3 direction. The imaginary plane S12 is positioned between the imaginary plane S11 and the reference plane S0. The height and other dimensions of the protruding portions 3A and 3B can be configured similarly to the first embodiment.

Other Embodiments

It is also possible to combine a plurality of the above embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-087492, filed Apr. 26, 2017, which is hereby incorporated by reference herein in its entirety.

What is claimed is:

1. A golf club head comprising:

a face portion;

a plurality of score lines formed on the face portion and extending in a toe-heel direction;

a plurality of protruding portions formed on the face portion and extending parallel to the plurality of score lines; and a plurality of recessed portions formed on the face portion and extending parallel to the plurality of score lines, wherein each protruding portion of the plurality of protruding portions and each recessed portion of the plurality of recessed portions are formed alternately in a direction orthogonal to the toe-heel direction, the plurality of protruding portions include a plurality of first protruding portions and a plurality of second protruding portions, each of the plurality of first protruding portions has an apex portion that is positioned in a first imaginary plane parallel to a reference plane that contains an edge of each of the plurality of score lines, and each of the plurality of second protruding portions has an apex portion that is positioned in a second imaginary plane parallel to the reference plane and different from the first imaginary plane.

2. The golf club head according to claim 1, wherein a bottom portion of each of the plurality of recessed portions is a flat plane positioned in a third imaginary plane parallel to the reference plane.

3. The golf club head according to claim 1, wherein the first imaginary plane is a same plane as the reference plane, and the second imaginary plane is a plane separated from the reference plane on a bottom portion side of the plurality of score lines.

4. The golf club head according to claim 1, wherein a depth of the plurality of recessed portions from the reference plane is 25 μm or less.

5. The golf club head according to claim 1, wherein each protruding portion of the plurality of first protruding portions and each protruding portion of the plurality of second protruding portions are formed alternately in the direction orthogonal to the toe-heel direction.

6. The golf club head according to claim 1, wherein the plurality of protruding portions include a plurality of third protruding portions, and each of the plurality of third protruding portions has an apex portion that is positioned in an imaginary plane parallel to the reference plane and different from the first imaginary plane and the second imaginary plane.

7. The golf club head according to claim 1, wherein a cross-sectional shape of each of the protruding portions in the direction orthogonal in the toe-heel direction is rectangular.

8. The golf club head according to claim 1, wherein the first imaginary plane and the second imaginary plane are planes separated from the reference plane on an opposite side to a bottom portion side of the plurality of score lines.

9. The golf club head according to claim 8, wherein each bottom portion of the plurality of recessed portions is positioned in a same plane as the reference plane.

* * * * *